US005111966A

United States Patent [19]

Fridman

[11] Patent Number: 5,111,966

[45] Date of Patent: May 12, 1992

[54] WATER DISPENSER

[75] Inventor: Jerome Y. Fridman, Tempe, Ariz.

[73] Assignee: Kelco Water Engineering, Inc., Tempe, Ariz.

[21] Appl. No.: 525,195

[22] Filed: May 18, 1990

[51] Int. Cl.[5] ..... B67B 5/08

[52] U.S. Cl. ..... 222/1; 222/56; 222/63; 222/67; 222/185

[58] Field of Search ..... 222/64, 65, 67, 56, 222/146.6, 185, 52, 63; 141/383; 62/389, 397

[56] References Cited

U.S. PATENT DOCUMENTS

| | | | |
|---|---|---|---|
| 774,986 | 11/1904 | Kammerer | 62/397 |
| 1,586,745 | 6/1926 | Hulse | 62/201 |
| 1,859,229 | 5/1932 | Bonine | 62/397 |
| 1,881,929 | 10/1932 | Pottenger, Jr. | 222/185 |
| 3,468,370 | 9/1969 | Castillo | 165/66 |
| 3,915,341 | 10/1975 | Brown | 222/67 |
| 4,030,634 | 6/1977 | Osborn | 222/23 |
| 4,597,509 | 7/1986 | Pereira | 222/129 |
| 4,629,096 | 12/1986 | Schroer et al. | 222/146.6 |
| 4,699,188 | 10/1987 | Baker et al. | 141/18 |
| 4,757,921 | 7/1988 | Snowball | 222/146.6 |
| 4,834,267 | 5/1989 | Schroer et al. | 222/185 |
| 4,881,661 | 11/1989 | Jones | 222/185 |
| 4,923,091 | 5/1990 | Sutera | 222/146.6 |
| 4,946,599 | 8/1990 | Craig | 62/397 |

*Primary Examiner*—Kevin P. Shaver
*Assistant Examiner*—Philippe Derakshani
*Attorney, Agent, or Firm*—Cahill, Sutton & Thomas

[57] ABSTRACT

An inverted water bottle, extending upwardly from a water dispenser, refills a container within the water dispenser, which container provides a source of water to a tap. Water from a source periodically refills both the water bottle and the container in response to upper and lower head pressure thresholds. A water processing system may be housed within the water dispenser to purify the water inflowing from the source of water.

22 Claims, 1 Drawing Sheet

WATER DISPENSER

BACKGROUND OF THE INVENTION

1. Field of the Invention

The present invention relates to water dispensers and, more particularly, to dual stacked automatically refillable water reservoirs for a water dispenser.

2. Description of the Prior Art

Conventional water dispensers found in homes and offices include a visible glass or plastic necked water bottle mounted upside down at the top of a cabinet. The opening and neck of the water bottle is disposed within a cup member. Water, under the force of gravity, flows out of the water bottle into the cup member until the pressure within the water bottle is reduced due to water evacuation to a degree sufficient to preclude further water outflow. The water level within the cup member, rising above the opening of the neck, prevents air inflow to the water bottle. The cup member is in fluid communication with a water tap. As water is drawn from the water tap, the water level within the cup member drops to a point just below the opening of the neck. Air may now enter the water bottle and permit a quantity of water to flow out of the water bottle and into the cup member. As the water level in the cup member rises above the opening of the neck, further air inflow is precluded and further water outflow from the water bottle stops. When the water bottle is emptied, it is replaced and the process is repeated.

Water dispensers of this type have become a fixture in offices and more and more residences have them. One of the drawbacks of this type of water dispenser is the need for continuing replacement of filled water bottles. Such replacement is laborious and for frail persons, the lifting and placement of the filled water bottle may be impossible to do. There is also an expense associated with replacement of filled water bottles since the water therein is usually processed or otherwise purified water and the associated water treatment costs and handling fees are relatively high by comparison with water treatment conducted in situ and using ordinary tap water.

Water treatment systems for home and office use have been available from a multitude of sources for many years. However, there has been strong resistance to use such water treatment devices in environments and at locations which have been the domain of conventional water dispensers. Part of this reluctance has to do with the fact that the cabinet or other structure housing the water treatment process does not "look" like a water dispenser. That is, without the well known well accepted visible upside down transparent water bottle being a part of the dispenser, acceptance and use has been limited.

SUMMARY OF THE INVENTION

A water container mounted within a cabinet includes a bell housing for receiving the neck of a water bottle extending upwardly from the cabinet. Tap water is processed and purified within the dispenser cabinet and transmitted to the bell housing and the water container. Water flowing through a float valve fills the water container until further flow is terminated by the valve. The water flowing into the bell housing fills the water bottle and a vent is provided to relieve any developing air pressure. A pressure sensor terminates fill when the head pressure reaches a predetermined level. As water is discharged through a tap in fluid communication with the container, the water from the water bottle will refill it. When the water level in the water bottle drops below a predetermined head pressure threshold, refilling of both the container and the water bottle will commence.

It is therefore a primary object of the present invention to provide a conventional looking water dispenser for dispensing tap water processed at the water dispenser.

Another object of the present invention is to provide an automatically filled water dispenser having vertically stacked water containers.

Still another object of the present invention is to provide apparatus for serially filling and evacuating two stacked water containers in a water dispenser.

Yet another object of the present invention is to provide apparatus for automatically filling an inverted removable water bottle for a water dispenser.

A further object of the present invention is to provide a conventional looking water dispenser which is automatically filled with purified water.

A still further object of the present invention is to provide a method for maintaining filled an inverted removable water bottle of a water dispenser.

A yet further object of the present invention is to provide a method for dispensing processed tap water from a seemingly conventional looking water dispenser.

These and other objects of the present invention will become apparent to those skilled in the art as the description thereof proceeds.

BRIEF DESCRIPTION OF THE DRAWINGS

The present invention will be described with greater clarity and specificity with reference to the following drawings, in which.

DESCRIPTION OF THE PREFERRED EMBODIMENT

Conventional water dispensers, used predominantly in offices, have become accepted fixtures. These water dispensers include an upstanding rectangular shaped cabinet having a removable inverted water bottle extending upwardly from the top of the cabinet. The bottles used to be of glass but are more and more of transparent plastic which look like the former glass bottles. Midway down the front of the cabinet is a push button water tap. A removable water catcher is disposed beneath the tap to collect spilled water. On some models, the water may be chilled and other water dispensers may include a second tap for heated water. Filled water bottles are usually provided by a service organization which delivers a plurality of filled bottles from time to time in accordance with demand. The water dispensed is usually purified water rather than tap water.

The costs attendant replenishment of emptied water bottles is substantial, particularly at locations where a lot of water is consumed on a daily basis. Accordingly, the operating costs attendant conventional water dispensers for office and home use are not inconsequential.

Figure 1:
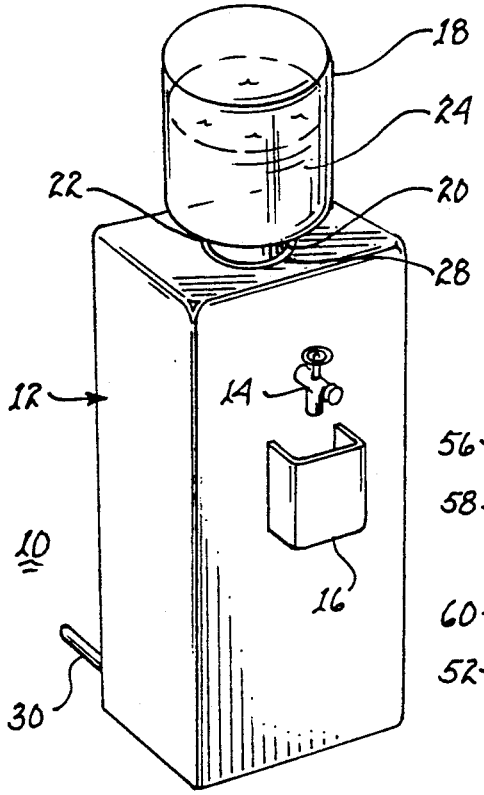
FIG. 1 illustrates the similarity between the present invention and a conventional water dispenser.

Referring to FIG. 1, there is shown a water dispenser 10, which, to all outward appearances, looks like a conventional water dispenser. It includes an upstanding generally rectangular cabinet 12 having a conventional water tap 14 extending from the front of the cabinet. A catch basin 16 is disposed beneath the tap to collect spills and accommodate small accidents. An inverted water bottle 18 having a neck 20 is mounted in the top of the cabinet. Neck 20 extends into the cabinet through a circular aperture 22 and the shoulder of the water bottle is supported on an annular pad 28. The water bottle is transparent, and sometimes of a light blue color, to provide a user a visual indication of the level of water 24 therein. Since many water dispensers are capable of chilling the water or heating the water, it is not unusual to find an electrical cord and attached plug extending from the rear side. The only externally visual departure of the water dispenser described herein from a conventional water dispenser is the presence of a water pipe 30 extending from the rear side. This pipe provides conventional tap water to be processed within water dispenser 10. The processed water is dispensed through tap 14.

Figure 2:
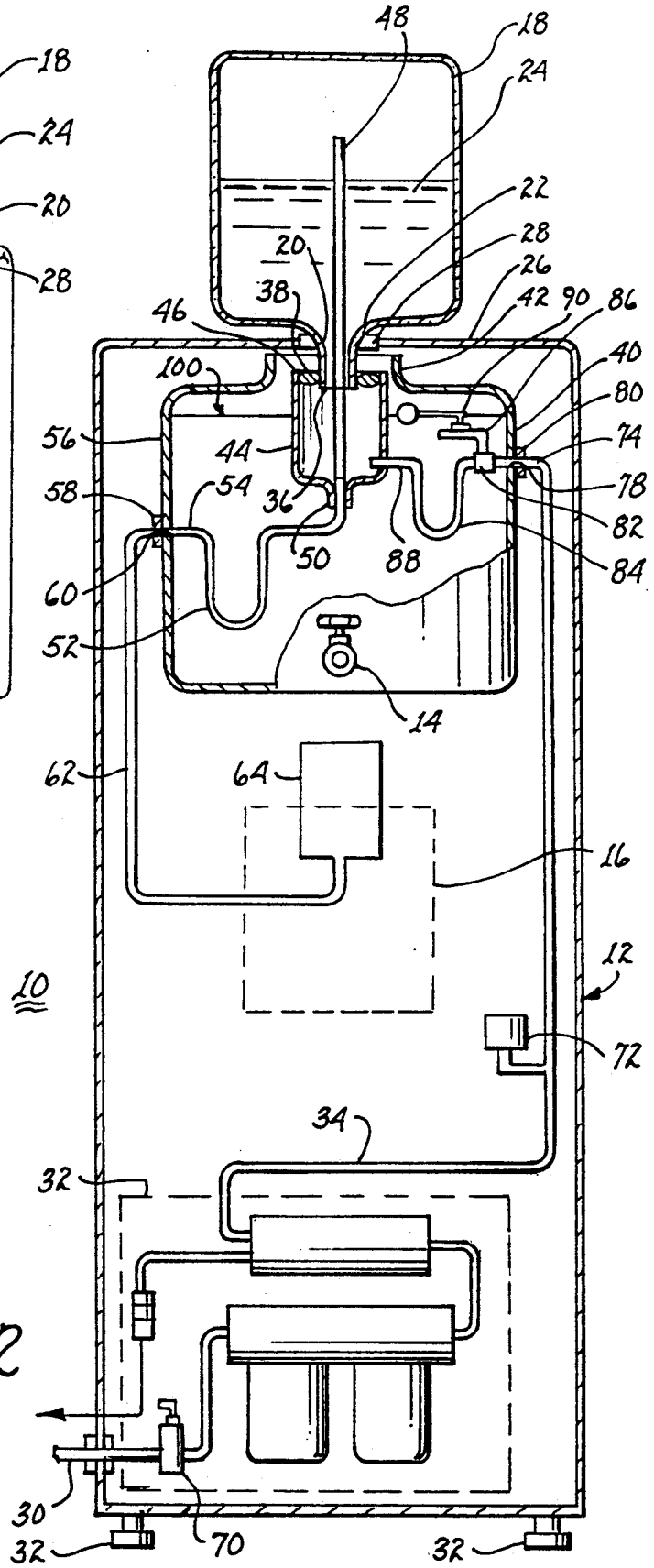
FIG. 2 is a generalized cross sectional view illustrating the operative elements of the present invention.

Referring to FIG. 2, there is shown a representative cross sectional view of the major operative components within water dispenser 10. Cabinet 12 may include an adjustable foot 32 disposed at each bottom corner to permit leveling of the water dispenser. To provide purified water from conventional tap water flowing into water dispenser 10 through pipe 30, a reverse osmosis water purification system may be connected to pipe 30. This system is depicted within the dashed line identified with numeral 33. A suitable reverse osmosis system is manufactured by Kelco Water Engineering, Inc. of Tempe, AZ. Purified water from reverse osmosis system 33 flows into tubing 34.

A container 40 is disposed within cabinet 12 beneath top side 26. It includes an open neck 42 in axial alignment with neck 20 of water bottle 18 and extends upwardly past outlet 36 of neck 20. An inverted bell housing 44 is mounted within container 40 and includes an upper end 46 extending partly into open neck 42 of the container and upwardly past outlet 36 of neck 20 A collar 38 serves as a seal or sealing means between neck 20 and bell housing 40. A transparent vent tube 48 is secured to lower neck end 50 of bell housing 44 and extends upwardly therefrom through neck 20 and terminates short of the inside top of water bottle 18. Vent tube 48 includes flexible tubing 52 connected to a conduit 54 extending through side 56 of container 40. A gasket 58 or other sealing means may be employed to prevent leakage through aperture 60 in side 56. Further tubing 62 extends from conduit 54 to an air filter 64. Accordingly, the air drawn into water bottle 18 through vent tube 48 will have been filtered by filter 64.

A solenoid valve 70 is disposed in tubing 30 to regulate the water flow through the tubing. A pressure sensor 72 for sensing the head pressure downstream, and primarily the level of water 24 in water bottle 18, is connected to tubing 34. A conduit 74 extends through aperture 78 in container 40, which conduit is in fluid communication with tubing 34. A gasket 80 or other sealing device is disposed about conduit 74 to prevent water leakage through aperture 78. A tee junction 82 is connected to conduit 74 to divide water flow into flexible tubing 84 and into hollow stud 86. A float valve 90 controls water outflow through hollow stud 86 as a function of the water level within container 40. Flexible tubing 84 is connected to a conduit 88 extending into invented bell housing 44. A seal may be employed to seal the junction between conduit 88 and housing 44.

Water flowing into water dispenser 10 through conduit 30 may be processed by reverse osmosis system 32 or other water processing apparatus. Alternatively, the water need not be processed at all. The processed, or unprocessed, water is conveyed from conduit 30 through tubing 34, including solenoid valve 70 to tee 82. When container 40 is empty or has water below water line 100, float valve 90 is open. Water flowing into tee junction 82 will therefore be discharged through hollow stud 86 into container 40. Simultaneously, a quantity of water will flow through tubing 84 and conduit 88 into bell housing 44. As the bell housing begins to fill, it will create a back pressure in tubing 84 and as a result of such back pressure, most of the water flowing into tee junction 82 will be discharged through hollow stud 86.

When the water within container 40 reaches water level 100, float valve 90 will close and further water discharge through hollow stud 86 will be precluded. The water entering tee junction 82 will be diverted solely into tubing 84 and flow through conduit 88 into bell housing 44. The bell housing will begin to fill and as the water level reaches outlet 36, water will flow through neck 20 into water bottle 18 since the top of the bell housing is sealed by collar 38. The air displaced due to water inflow to the water bottle will be vented through vent tube 48 and exhausted through filter 64. The pressure necessary to force water into water bottle 18 is established by collar 38 disposed intermediate neck 20 and the interior surface of the bell housing to render the bell housing a closed vessel.

As the water level within water bottle 18 rises, greater and greater head pressure will be sensed by pressure sensor 72 When a predetermined head pressure (water level) is achieved, pressure sensor 72 will trigger actuation and closing of solenoid valve 70. Thereafter, further water will not flow through tubing 30.

When tap 14 is opened to draw water from water dispenser 10 the water will flow directly from within container 40. As water level 100 in container 40 drops, float valve 90 will open. Since solenoid valve 70 has been deactivated to prevent water flow through tubing 30, water discharge through hollow stud 86 from tubing 34 will not occur. As soon as float valve 90 opens, the head pressure represented by the water within water bottle 18 will cause water to discharge from the water bottle, through bell housing 44, flexible tubing 84, tee junction 82 and hollow stud 86. This water flow will continue until the water level within container 40 rises and float valve 90 closes the hollow stud. Accordingly, water bottle 18 will replenish the water within container 40 and provide a visual effect to a user of a decreasing water level within the water bottle.

The water level within water bottle 18 is allowed to decrease to a predetermined level, which level is reflective of an established head pressure present at pressure sensor 72. When the head pressure drops below the established pressure threshold pressure sensor 72 will actuate and open solenoid valve 70. Thereafter, water will flow through tubing 34 to refill container 40 and water bottle 18 as described above.

It may be noted that the water dispensed from water dispenser 10 is conventional inexpensive tap water which may have been purified or not, at the choice of the user. Additionally, periodic replacement of water bottles is no longer necessary with a consequential financial saving and avoidance of the difficulties attendant replacement of emptied conventional water bottles.

The various components of water dispenser 10 have been engineered to permit ready removal, cleaning and sterilizing to meet all sanitation related requirements.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. A water dispenser for dispensing water, said water dispenser comprising in combination:

a) a cabinet, said cabinet including a top side and an aperture imposed in said top side;

b) a source of water to be drawn at will;

c) a container disposed within said cabinet for receiving water from said source of water;

d) means for regulating water flow from said source of water into said container as a function of the water level in said container;

e) an inverted water bottle supported by and extending upwardly from said cabinet for providing a visually perceivable indication of the water level within said water bottle, said water bottle including a neck and an outlet therein, said neck being disposed within said aperture of said cabinet;

f) a housing disposed within said cabinet for receiving said neck and said outlet of said water bottle;

g) means for sealing said neck with said housing;

h) means for conveying a flow of water from said source of water into said housing and into said water bottle;

i) means for venting said water bottle as a function of the water level within said water bottle;

j) means for controlling water flow from said source of water to said container and to said water bottle as a function of the back pressure presented by said conveying means; and k) means for dispensing water from said container at will.

2. The device as set forth in claim 1 including means disposed within said water dispenser upstream of said container for purifying the water from said source of water.

3. The device as set forth in claim 1 wherein said venting means includes tubing extending upwardly into said water bottle through said opening and said neck.

4. The device as set forth in claim 3 including means for filtering any air drawn through said tubing and into said water bottle.

5. The device as set forth in claim 4 wherein said aperture includes means for supporting a shoulder of said water bottle.

6. The device as set forth in claim 1 wherein said housing includes an inverted bell housing having an upwardly extending skirt and an upper open end for receiving said neck and wherein said sealing means is disposed intermediate said skirt and said neck.

7. The device as set forth in claim 6 wherein said housing includes means for directing water into said housing from said conveying means.

8. The device as set forth in claim 7 including means for exhausting water from said water bottle through said directing means, through said controlling means and into said container.

9. The device as set forth in claim 8 wherein said venting means includes means for venting said water bottle through said housing.

10. The device as set forth in claim 9 wherein said venting means is transparent within said water bottle.

11. A water dispenser for dispensing water from a continuous source of water, said water dispenser including a cabinet and an inverted water bottle extending from the cabinet, said water dispenser comprising in combination:

a) means for containing water within the cabinet;

b) means for dispensing water on demand from said containing means;

c) means for serially filling said containing means and the water bottle periodically with water from the source of water;

d) means for discharging water from the water bottle into said containing means in response to dispensation of water;

e) pressure sensor means for sensing the head pressure presented by the water bottle; and f) means for actuating said filling means in response to said pressure sensor means and as a function of the head pressure presented by the water bottle.

12. The device as set forth in claim 11 including means disposed within the cabinet for purifying the water received from the source of water.

13. The device as set forth in claim 11 including means for continuously venting the water bottle.

14. The device as set forth in claim 11 including means for disengaging the water bottle from the cabinet for cleaning and replacement purposes by raising the water bottle.

15. The device as set forth in claim 11 including means for terminating filling of said containing means as a function of the water level within said containing means.

16. The device as set forth in claim 11 including means for maintaining the water level within said containing means essentially constant and for maintaining the water level within the water bottle at an elevation higher than the water level within said containing means.

17. A method for dispensing water from a water dispenser connected to a source of water and including a cabinet and an inverted water bottle extending from the cabinet, said method comprising the steps of:

a) containing water within a container in the cabinet;

b) dispensing water on demand from the container;

c) serially filling the container and the water bottle periodically with water from the source of water;

d) discharging water from the water bottle into the container in response to dispensation of the water; and e) sensing with a pressure sensor the head pressure presented by the water bottle; and f) activating said step of filling in response to the pressure sensed by the pressure sensor and as a function of the head pressure presented by the water bottle.

18. The device as set forth in claim 17 including the step of purifying the water received from the source of water.

19. The device as set forth in claim 17 including the step of continuously venting the water bottle.

20. The device as set forth in claim 17 including the step of terminating said step of filling the container as a function of the water level within the container.

21. The device as set forth in claim 17 including the step of disengaging the water bottle from the cabinet for cleaning and replacement purposes by raising the water bottle.

22. The device as set forth in claim 17 including the step of maintaining the water level within the container essentially constant and the step of maintaining the water level within the water bottle at an elevation higher than the water level within the container.

* * * * *